US005779553A

United States Patent [19]

Langford

[11] Patent Number: 5,779,553

[45] Date of Patent: Jul. 14, 1998

[54] WATERSLIDE WITH UPHILL RUNS AND PROGRESSIVE GRAVITY FEED

[76] Inventor: Frederick Langford, 212 Crest Rd., P.O. Box 245, Cape May Court House, N.J. 08210

[21] Appl. No.: 718,124

[22] Filed: Sep. 18, 1996

[51] Int. Cl.[6] ..... A63G 21/18

[52] U.S. Cl. ..... 472/117; 104/73

[58] Field of Search ..... 472/116, 117, 472/128; 104/69, 70, 73; 137/565, 563

[56] References Cited

U.S. PATENT DOCUMENTS

| | | | |
|---|---|---|---|
| 4,484,739 | 11/1984 | Kreinbihl et al. | 472/117 |
| 5,011,134 | 4/1991 | Langford | 472/117 |
| 5,213,547 | 5/1993 | Lochtefeld | 472/117 |

*Primary Examiner*—Kien T. Nguyen
*Attorney, Agent, or Firm*—Eckert Seamans Cherin & Mellott

[57] ABSTRACT

For managing water flow in a waterslide, drains are provided at one or more points between a top and bottom of a course, coupled to conduits providing gravity flow paths bypassing portions of the course. The course is defined by a sluice with a generally downhill gradient and can have at least one point of relatively lower elevation leading into a subsequent uphill run. A water supply is provided to the top of the course and optionally to other points along the course, for example being pumped from a lowermost splashdown pool. The water flows downward toward low points, flowing in the direction of waterslide riders or opposite thereto. The water is collected at one or more of the drains and fed to a lower elevation water emitter in the sluice of the same course or another course, especially at a slope leading or trailing a peak. This reduces pumping requirements because the water is used more than once along the course, and can be used to prevent intermediate pools that would reduce the riders' speed. A number of gravity paths can be provided pairing valleys with subsequent peaks or slopes.

15 Claims, 2 Drawing Sheets

WATERSLIDE WITH UPHILL RUNS AND PROGRESSIVE GRAVITY FEED

BACKGROUND OF THE INVENTION

1. Field of the Invention

The invention relates to waterslides, and in particular concerns managing the flow rate of water at different sections along a generally downhill waterslide course, in a course having successive uphill and downhill runs and varying gradients. At different sections, water is injected into the waterslide sluice for skimming over by riders, flowing along with the riders, or simply wetting the sluice to reduce friction. This is accomplished according to the invention by one or more gravity flow paths having sluice drains coupled by conduits to outflow boxes, in order to drain water from the sluice at higher elevations and to reinsert the water at lower elevations. Low points or valleys leading into uphill runs are drained and the collected water is inserted at uphill or downhill runs disposed at lower elevations along the course. By bypassing and feeding the water back into the system at a lower elevation section along the course, the flow rate is managed optimally for the course contour, pumping requirements are substantially reduced, and problems with pooling water are minimized.

2. Prior Art

In general, waterslides employ a downhill course from a point of entry to a point of exit, for example at a splashdown pool. Water is pumped continuously from the splashdown pool up to the entry point, which can have an entry pool. Water pumped continuously into the entry pool overflows into the trough or sluice defining the course to be traversed by the riders, and flows continuously downhill from the entry to the splashdown pool, where the water is recycled by pumping it up to the entry once again.

Various types of waterslides are known, some intended to carry a high volume torrent of water that flows turbulently along with the users. Other types have a smaller volume flow, for example, only enough water to wet the surface and minimize friction between the rider and the surface of the sluice for sliding. Whatever volume is provided at the higher elevation point of water insertion flows down the course to a lower elevation for collection and recycling.

The riders preferably ride on a mat as in U.S. Pat. No. 5,011,134, or a flotation tube as in U.S. Pat. No. 5,020,465, both to Langford, especially on waterslides that are particularly long or fast. It is also possible to ride without a mat or flotation device.

It would be advantageous in some instances to control the amount of water in the sluice at different points due to the specific contour or gradient of the course. The U.S. Pat. No. '134 patent, and also U.S. Pat. No. 5,230,662 (Langford) disclose waterslides having an elongated trough or sluice that has one or more uphill runs between the higher elevation entry point and the lower elevation splashdown pool. The successive downhill and uphill runs are exciting in that the course resembles that of a roller coaster and can have any number of curves, downhill sections, uphill sections and even peaks at which riders can become airborne, provided the riders have sufficient kinetic energy to pass over the successive peaks.

A problem is encountered with waterslides having uphill runs, in that a pool of water collects at each low point or valley leading into an uphill run. Such a low point or valley is inherent in having an uphill run that is lower along the course than a higher elevation entrance. When moving users or "riders" encounter a depth of static water in such a pool, viscous friction slows them down substantially. Although riders may skim across the surface of a pool, the ease with which a rider can maintain speed over the pool introduces variables related to the weight of the rider, the rider's skill in controlling the flotation device or mat, the configuration of the flotation device, the alignment of the flotation device upon encountering the pool, etc. Deep static pools generally are impediments to the riders.

There also is a need to manage water flow generally. Design constraints may require the insertion of a substantial volume of water flow along the course, including at points uphill from a potential pool. It would be advantageous to manage the water flow for various purposes, for example employing only a small volume flow of water where needed to merely wet uphill runs or steep runs generally, and perhaps to provide a more robust flow to move riders along a slower low-gradient section approaching a downhill slope, etc.

In the U.S. Pat. No. '134 patent, an uphill run is facilitated by providing an elongated drain at the low point or valley, which drains excess water from the low point. Water then must be added to the sluice further along the course, for example by pumping water from the splashdown pool onto the surfaces of the sluice further down the course from the drained low point or pool. The drain is coupled to a conduit leading to the splashdown pool. Water that is either drained to the splashdown pool or carried to the splashdown pool along the sluice together with the riders, is pumped to the highest elevation or course entry point. Supplemental water is provided by additional sprays that either require additional pumps or comprise loads on the main pump used to lift recirculating water to the entry point.

According to the foregoing patents, the intermediate drain at the low point is useful to reduce the depth of water, i.e., to eliminate a static pool at the valley, but is simply drained to the splashdown pool. The rate at which the intermediate drain empties the low point may be critical, because it may or may not be desirable in a particular course to have the riders encounter at least some water in the pool or valley such that a quantity of this water can be carried along with the riders, e.g., to wet the sluice up and over a next successive peak. Thus water must be removed to prevent the accumulation of a deep pool, with a sufficient amount left in the course to reduce friction between the rider and the sluice up the following rise.

Flow requirements for the upstream section of the course leading downward toward the valley also must be accommodated. Control of the flow rate of water into the valley and out through the drain can become a problem, such as when the frequency of rider passages varies and changes the rate at which water arrives at the drain area, or the rate at which water is carried forward with passing riders. The U.S. Pat. Nos. '134 and '662 deal with the problem by restricting the drain area to an elongated central area along the bottom of the sluice, and also by substantially draining out the low-point pool and then providing the supplemental water injectors to spray additional water onto the uphill and/or downhill sides of the next peak following the drained pool along the riders' path. This requires separate pumping capacity for feeding the entry point and for feeding the supplemental injectors. If supplemental injectors are to provide a downstream flow rate equal to that of the entry section, the required pumping volume is doubled (although the supplemental injectors at a lower elevation than the entry require less head).

Another water management technique, disclosed in U.S. Pat. No. 5,453,054—Langford, is to vary water injection over time. A gush of water is emitted from an entry pool together with riders departing the entry pool (or an intermediate pool), using a controllable dam or weir that is lowered as a rider is detected approaching the lip of the pool, to briefly increase the flow from the entry pool into the sluice. In that case the amount of water flowing in the sluice is related to the frequency of rider passages. The total amount of water used is less than would be required if a constant flow was maintained of a sufficient volume to provide a comparable continuous flow of water moving together with the riders. Instead of a constant flow, a water passes through the sluice in gushes coinciding with riders. The foregoing means and functions in the cited Langford patents are also applicable to the present invention, and the disclosures of the patents are hereby incorporated in this disclosure in their entireties.

It would be advantageous to further improve the management of water injection and drainage in a waterslide, especially one having one or more uphill runs. It is an aspect of the present invention that flowpaths drain water from the sluice at relatively higher elevations, and that same water is used to feed sections at relatively lower elevations where needed. This has the benefit of permitting different water flow rates at different points along the sluice as most appropriate to the contour of the course, without adding to the required pumping capacity. Specifically, drains remove a portion of the water from initial high volume flow areas at higher elevations along the sluice, and also preferably from low points or valleys. Conduits feed this water to leading or trailing slopes, peaks, and the like, that are at a lower elevation than the collection drain, and preferably are further along the course than a low point or valley defining a potential static pool. The conduits coupling paired higher elevation drains and lower elevation outflow boxes define flowpaths that can overlap and can have different capacities as needed to manage a variable flow of water at different sections of the course. This water is available without requiring additional pumping capacity to supply additional water where needed because the extra water is collected at a higher point on the course and bypasses the sluice and any peaks along the way between the collecting drain and the outflow water emitter.

SUMMARY OF THE INVENTION

It is an object of the invention to provide a waterslide with a drain for collecting water accumulating at zones of relatively higher elevation, coupled to one or more water emitters or outflows disposed at a relatively lower elevation, whereby water is injected for supporting riders at the lower elevation without the need to pump water thereto.

It is another object in a waterslide having a generally downward course and water flowpath, to permit the volume flow rate of the water in the sluice to be varied from point to point along the course, for example to provide a low volume wetting flow for steeper inclines or faster sections, and a higher volume current flow through more gentle inclines or where it is desirable to reduce the riders' speed.

It is also an object to regulate the depth of water in a waterslide having uphill runs following downhill runs along a rider path by removing water at low points or valleys to prevent viscous braking effects, and to emit the removed water at an intermediate elevation by use of a gravity feed conduit.

It is a further object to minimize the volume of water pumped into a waterslide course by using water pumped to a high elevation at more than one point along the course, without requiring that the water used in lower sections all arrive by way of the sluice.

It is another object to provide a waterslide having successive valleys and peaks along a course by coupling relatively higher elevation valleys by gravity feed conduit to lower elevation peaks or slopes, and thereby to maximize the available water supply while minimizing the need for pumping.

These and other objects are accomplished by a waterslide and a method for managing water flow in the waterslide. Drains are employed at one or more points intermediate a top and bottom of a course, and conduits provide gravity flow paths to outflow emitters at lower elevations, thereby bypassing portions of the sluice while providing gravity flow from the beginning of the course to the end. The gravity flowpaths can bypass peaks following low points or valleys or can bypass other sections of the sluice, provided the drain is disposed at higher elevation than the outflow emitter. Water can also be collected leading into slopes such as downhill runs, less water generally being needed for riders to traverse downhill runs without loss of speed.

The course is provided by a sluice with a generally downhill course or route, having at least one point of relatively lower elevation leading into a subsequent uphill run along the course, carrying riders along the course due to gravity and flow of water. The basic supply of water is pumped in a circulating path from a lowermost splashdown pool to the top of the course, and optionally to other points of relatively higher elevation than the splashdown pool. The water flows generally downhill in the sluice by gravity, toward the low points. One or more drains removes water at or upstream of the low point(s) and is coupled by a gravity flow conduit to bypass a sluice section and to feed water to an emitter at a still lower elevation in the sluice, especially the slope leading or trailing a further peak. Paired collection drains and emitters coupled to the drains by conduits can also provide collection/emission flow paths that overlap one another along the course. Management of the flow in this way substantially reduces pumping requirements because water is reused before flowing into the terminal splashdown pool. Nevertheless, flow is provided where appropriate and the arrangement can prevent the accumulation of overly deep intermediate pools that would tend to slow the riders' speed. A number of gravity paths can be provided pairing valleys with subsequent peaks or slopes.

In addition to overlapping one another, the gravity paths can involve more than one waterslide course, so long as water is collected from a higher elevation point to feed a lower elevation point, i.e., by gravity flow. The flow rates of the drains and gravity paths can be adjusted using different heads and flow rates between the drains and further water emitters to arrange for different flow volumes at different points along the waterslide course.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figures 1, 2:
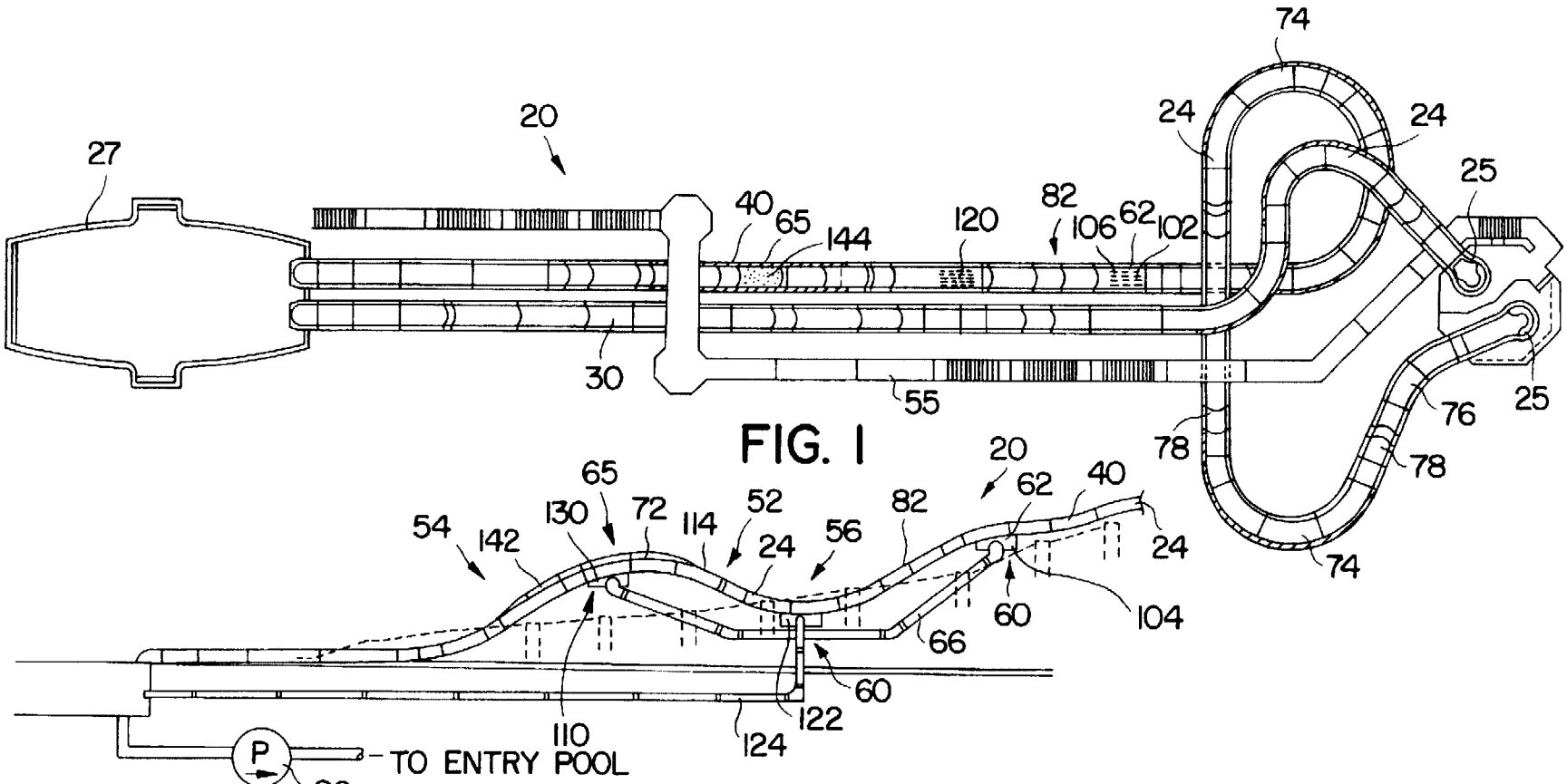
FIG. 1 is a plan view showing a waterslide course according to the invention, which in this embodiment includes two courses and a walkway.
FIG. 2 is a partial elevation view showing the elevation of one of the courses in FIG. 1 through various gradients, including uphill runs.

Referring to FIGS. 1 and 2, a waterslide 20 according to the invention generally includes a sluice 24 defining a generally downhill course from an entry point or pool 25 to an exit such as a splashdown pool 27. In FIGS. 1 and 2, two generally coextensive sluices are shown for purposes of comparison. A conventionally graded course 30 has a continuously downhill contour. The angle of the gradient may vary but generally proceeds downhill such that water inserted at the entry point flows continuously downwardly. Another course 40 has both uphill runs 52 and downhill runs 54 along the route between the high elevation point of entry 25 and the lowermost point of exit at splashdown pool 27. The invention is applicable to the continuous gradient course 30 for varying the water flow volume at different sections along the course, but is particularly apt for course 40, having uphill sections 52 following downhill sections 54 in the direction that riders traverse the course. In the embodiment shown, riders walk up a walkway 55 and queue up for access to one of two entry pools 25.

Sluice 24 can be made in coupled segments of fiberglass, either mounted on columns or on footings placed in the ground. The sluice is arranged to carry riders (not shown) along the course together with water. The water is provided for either or both of reducing friction between the riders and the surface of sluice 24, and carrying the riders along the course, on and in a flow of water. The water is pumped from splashdown pool 27 to entry point 25, and optionally can be emitted along the course at various other points such that the water flows toward a point of lower elevation, either forward or rearward of the point of emission into the sluice. Emission of water can be at a continuous flow rate, or alternatively, the rate can be varied, for example, to provide a gush of water with embarking riders as in U.S. Pat. No. 5,453,054—Langford, which has been incorporated herein.

It is desirable that the flow of water be sufficient to ensure a low friction passage for the riders, without unduly damping the riders' speed. Along downhill runs, the water generally flows together with the riders. However, at sections having a low gradient, at low points or valleys 56 between downhill runs 54 and subsequent uphill runs 52, and also at sections following a very steep fast section at which riders may outstrip the flow rate, too much water can impede the riders. For example, in low points or valleys 56, water tends to pool rather than flow, thereby impeding the riders by viscous friction. According to the invention, one or more drains 60 is disposed in sluice 24 to remove water at points where excess water is not desirable. The drains 60 can be structured as in U.S. Pat. Nos. 5,011,134 and 5,230,662, both to Langford, which have also been incorporated. However, according to the invention, water is removed via one or more drains 62 disposed at higher elevation points along the sluice, and is inserted again into sluice 24 by a water outflow emitter 65 disposed at a lower elevation on sluice 24 than drain 62. The water outflow emitter 65, which can structurally resemble a drain except that it is operated to insert water rather than remove it, is coupled by at least one conduit 66 to the higher elevation drain 62. Thus, water is collected from sluice 24 at an elevation lower than that of entry point 25, and is inserted again at a still lower elevation via the water outflow emitter 65. This permits the volume flow rate of water in sluice 24 to be different at different points along the course; can be used to prevent the accumulation of speed damping pools; and minimizes the amount of water that needs to be pumped from splashdown pool 27 to the point of entry 25 at the top of the course.

Course 40 defines a plurality of peaks 72 and valleys 56 as well as curves 74, which preferably are banked or have high side walls. Thus the course is traversed in a manner resembling a roller coaster. It is inherent in such an arrangement of peaks and valleys that water cannot readily flow continuously from entry point 25 to splashdown pool 27. Nor does the water flow strictly in the same direction as the moving riders. By extracting a portion of the water flow at higher elevations and reinserting that water at a lower point, the flow rate or volume of water can be managed. Where low points or valleys 56 occur along the course at a higher elevation than a subsequent section along the course such as an uphill or downhill slope, water can be removed by drain 60 at the low point and reinserted at a successive slope or the like. If a low point is provided at an elevation close to the elevation of the end of the course, the drained water can be directed into the splashdown pool 27. Advantageously, water is reinserted at either or both slopes adjacent to an intermediate peak 72. The water flows in opposite directions downwardly from both sides of the peak relative to the riders' path.

In the embodiment shown, following entry point 25 the riders follow a short relatively horizontal section 76, then pass through two successive downward inclines 78 followed by banked turns 74. At these relatively higher sections of the course, sluice 24 preferably carries all the water that overflows the entry pool 25 after having been pumped to the entry point. The riders pick up speed.

As the riders accelerate, the quantity of water flowing in sluice 24 may be an impeding factor. Preferably, leading into a steep incline 82 for substantial acceleration into a subsequent uphill run, a first drain 62 removes a portion of the water in sluice 24. This reduces the water flowing down acceleration incline 82 to a minimum needed to maintain a low friction surface, without impeding acceleration of the riders. Removal of this water also reduces the extent to which water tends to accumulate in the following low point 56.

In the embodiment shown, the sluice is approximately four feet (1.3 m) wide and has rounded bottom as appropriate for riders on inflated tubes (not shown). Pump 90 continuously moves about 1,400 gal./min. (about 5,300 l/min) from splashdown pool 27 to entry point 25, where the entry pool overflows into sluice 24, either continuously or in gushes or the like. Acceleration incline 82 is encountered leading into an initial valley 56. This incline drops about 16 feet (5 m) over a horizontal distance of 43 feet (13 m) for accelerating the riders. Only a volume of water sufficient to wet sluice 24 is needed on the incline, as excess water flow would slow the riders.

Figure 3:
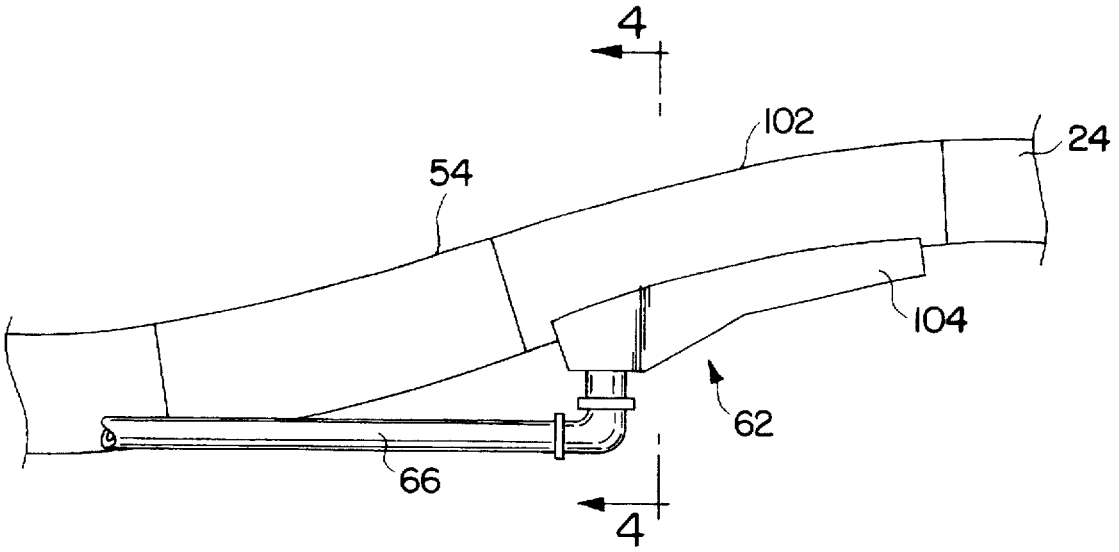
FIG. 3 is a section view showing a gravity drain and conduit arrangement according to an embodiment of the invention.
Figure 4:
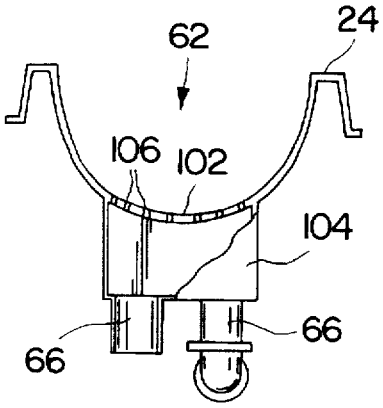
FIG. 4 is a section view taken along line 4—4 in FIG. 3, illustrating a section of sluice with a slotted form of collection drain.
Figure 5:
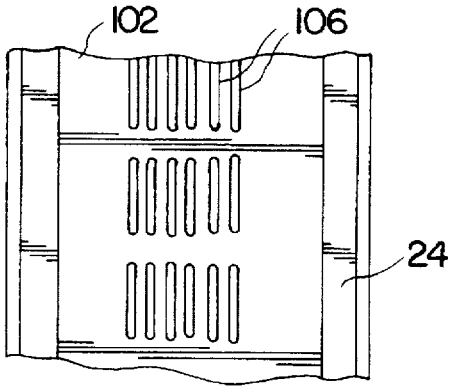
FIG. 5 is a partial plan view from above in FIG. 3, illustrating the slotted collection drain of FIG. 4.

Therefore, as also shown in FIGS. 3, 4 and 5, drain 62 is provided in the form of a slotted section 102 in the bottom of sluice 24, having a closed box 104 thereunder coupled to a conduit 66 leading to an outflow emitter 65 as in FIG. 2, disposed at a lower elevation.

Drain 62 can have an array of slots 106 disposed over box 104 for a distance along the sluice, e.g., about 4 feet (1.2 m). In addition, two or more such boxes 104 can be provided, either disposed laterally of one another or longitudinally, in order to extract sufficient water while allowing some of the water to pass over drain 62 and remain in sluice 24. Box or boxes 104 are coupled to one or more water emission points 110 downstream by two eight inch (20 cm) PVC pipes forming conduit 66. For example, an array of slots, each 8 inches (3 cm) long by 5/16 inch wide (0.8 cm), spaced 2.5 inches (1 cm) on centers, can be provided over a distance of about 4 feet (1.2 m) along the sluice, as shown in FIG. 5. Such a drain extracts about 1,200 gal./min. (4,500 l/min) from sluice 24, leaving a substantially reduced flow of about 200 gal./min (750 l/min) in the sluice with the riders. Thus, drain 62 removes about 85% of the water flow volume leading into acceleration slope 82, leaving 15% to wet the sluice down slope 82.

The water remaining in sluice 24 flows to the low point or valley 56 leading into an upslope toward the next peak 72, and although the riders carry some of the water forward up the next incline 114 toward peak 72, much of the water flows back down incline 114 in a direction opposite the direction of the riders. This water is removed by a further drain 120 disposed in the bottom of valley 56, which drains any accumulating water into a depending catch box 122 coupled to a 6 inch (15 cm) PVC pipe forming conduit 124. Conduit 124 could likewise lead to a point downstream along the course at a lower elevation yet, but in the embodiment shown conduit 124 flows directly to splashdown pool 27. Valley drain 120 is likewise slotted as shown in FIG. 5 and as above, and according to the foregoing example requires a flow capacity of at least 200 to gal./min., or up to 400 gal./min to accommodate a gush of water (750–1,500 l/min), to drain the valley of all accumulating water.

Figure 6:
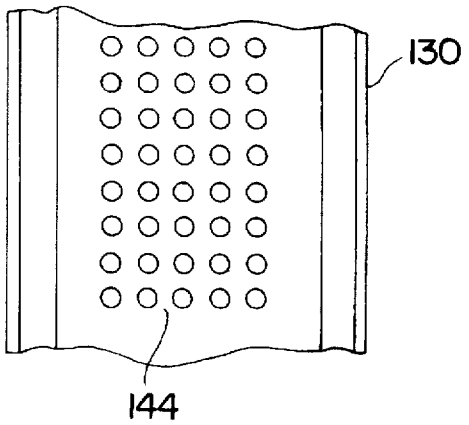
FIG. 6 is a plan view showing a perforated sluice section, which is preferably used as an outflow emitter.

The substantial flow volume removed by the high elevation initial drain 62 along the course is coupled by the two conduit pipes 66 to an outflow box 130, or another form of water emitting structure, disposed at the downstream side of peak 72. In the example shown, outflow box 130 is at an elevation about 4.5 feet (1.4 m) lower than initial collection drain 62. Although conduit 66 arches downwardly and upwardly from drain 62 to outflow box 130, for example being mounted along the flange edge of sluice 24 as in FIG. 3, the head is sufficient for gravity flow of water through conduit 66 and back into sluice 24 at downslope 142 following peak 72. This flow of about 1,200 gal./min. (4,500 l/min) is preferably directed back into sluice 24 through a plate or section 144 along the bottom of sluice 24 that is perforated with half inch (1.2 cm) vertically oriented holes on two inch centers, shown in FIG. 6. One or more such perforated plates extend about 5 feet (1.5 m) along sluice 24. Whereas the holes in outflow plate 144 present a flow restriction, the water is emitted upwardly into sluice 24 with some pressure, defined in part by the head of the flow path, providing a bubbling fountain area encountered by the riders upon passing over peak 72. The water then continues down the course, and in the embodiment shown, toward splashdown pool 27, where the water is again pumped to entry point 25.

Thus it is an aspect of the invention that a proportion of the water flowing in the sluice (e.g., about 85% of the volume) is collected from the course at a higher elevation, especially at a point adjacent to or leading into an accelerating downhill run to a valley. This water is reinserted into the sluice at a relatively lower elevation such as at a point beyond a peak following an uphill run from the valley to the peak, using a drain and conduit system that bypasses the valley. As a result, the rate of water flow in the sluice is different at different points, being reduced where only wetting is needed and removed at low points where there is a danger of static pooling.

The invention is illustrated in the drawings with reference to a waterslide having one intermediate valley 56 and one peak 72 between entry 25 and splashdown pool 27. It will be appreciated that any number of water extraction drains at higher elevation can be coupled by conduits to outflow boxes or other water emitting means at lower elevations for regulating the flow rate of the water at particular points along the course. It is likewise possible, especially in a two course waterslide park as shown in the drawings, to use water drained from a higher point on one slide to feed or supplement water flow in another course. The invention is thus subject to variations wherein gravity-feed course-bypassing conduits extract and usefully employ a portion of the flow to reduce the need for pumping as well as to solve flow and pooling related problems.

Apart from the foregoing exemplary structures, the invention also concerns the general method of dealing with water flow along a generally downhill sluice. This method generally includes providing sluice 24 with points of relatively higher and lower elevation, for example with a downhill section 82 leading into a subsequent uphill run 114 along the course, emitting water into the sluice above the relatively higher elevation and carrying the riders along the course via water flowing along downhill. A portion of the water is collected from sluice 24 via a drain 62 coupled via conduit 66 to a water emitter 130 in sluice 24 at a still lower elevation than drain 62, thus inserting the water again at the lower elevation and providing for diminished flow volume between drain 62 and water emitter 130. The invention permits the same course to have sections with robust flow volume as well as sections where the sluice surface is merely wetted, and also reduces pooling problems as well as pumping requirements that would otherwise be inherent in a management of water flow rate variations such as with a succession of downhill and uphill runs along the course.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A waterslide comprising:

a sluice defining a generally downhill course having a high elevation entry point, the sluice being arranged to carry riders along the course and water for at least one of reducing friction between the riders and the sluice, and carrying the riders along the course;

means for emitting water into the sluice adjacent to the entry point, such that said water flows toward a point of lower elevation along the course;

a drain disposed in the sluice at a water extraction point at an elevation below the entry point; and, a water emitter in the sluice at a still lower elevation than the water extraction point, coupled by at least one conduit to the drain, whereby water is collected from the course from the point of relatively lower elevation and inserted again at the still lower elevation via the water emitter.

2. The waterslide of claim 1, wherein the sluice defines a course having at least one valley leading into a subsequent uphill run to a peak along the course, and wherein the conduit bypasses the peak.

3. The waterslide of claim 2, comprising at least two paired drains and water emitters along the course, each of the paired drains and water emitters being coupled by respective said conduits.

4. The waterslide of claim 3, comprising a highest elevation entry section and a lowest elevation splashdown pool, and wherein the means for emitting water into the sluice at the relatively higher elevation comprises a pump coupled to the splashdown pool and to the entry section for pumping water from the splashdown pool to the entry section, and wherein said drains, conduits and water emitters provide flow paths bypassing at least some of the peaks along the course.

5. The waterslide of claim 3, wherein the conduits coupling the drains and water emitters at least partly bypass one another.

6. The waterslide of claim 1, wherein the course defines a at least one of peaks and valleys, at least one said valley along the course being higher in elevation than a subsequent section along the course, and wherein the drain is disposed at the valley.

7. The waterslide of claim 6, wherein the subsequent section is an uphill run leading into a peak along the course.

8. A method for managing water flow along a sluice defining a generally downhill course for carrying riders along the course together with water, comprising the steps of:

emitting water into the sluice at a relatively high elevation, the water reducing friction between the riders and the sluice, and carrying the riders along the course, the water flowing along the course toward a point of lower elevation;

collecting water from the sluice via a drain adjacent to the point of relatively lower elevation, and coupling the collected water to a water emitter in the sluice at a still lower elevation than the drain via at least one conduit, whereby water is collected from the course from the point of relatively lower elevation and inserted again at the still lower elevation via the water emitter, thereby bypassing a portion of the sluice.

9. The method of claim 8, comprising providing at least one of peaks and valleys along the course, and further comprising draining water from at least one said valley having an elevation higher than a subsequent section along the course, and feeding water drained from the valley to the subsequent section.

10. The method of claim 9, comprising providing a plurality of the valleys along the course that are higher in elevation than subsequent sections along the course, and at least two of the valleys are coupled by corresponding drains, conduits and water emitters to respective points of still lower elevation for feeding water to the subsequent sections.

11. The method of claim 8, comprising locating the water emitter adjacent to a peak along the course, whereby water is emitted onto at least one of a leading slope and a trailing slope adjoining the peak.

12. The method of claim 11, wherein the water emitter is located along the course following an uphill run leading into the peak, so as to discharge onto a downhill run beyond the peak.

13. The method of claim 11, comprising locating the water emitter on a leading side of a peak along the course, such that the water flows in a direction opposite the riders.

14. The waterslide of claim 8 comprising providing a highest elevation entry section and a lowest elevation splashdown pool with a plurality of intermediate peaks and valleys, and pumping water from the splashdown pool to the entry section, to the entry section, such that said conduits, drains and water emitters provide flow paths bypassing at least some of the peaks along the course.

15. A waterslide comprising:

a sluice defining a generally downhill course having a high elevation entry point and a low elevation exit point, the sluice being arranged to (i) carry riders along the course, and (ii) carry water along the course for at least reducing friction between the riders and the sluice, and carrying the riders along the course;

means for emitting water into the sluice adjacent to the entry point such that said water flows toward a point of lower elevation along the course;

a drain disposed in the sluice at a water extraction point at an elevation below the entry point and above the exit point; and a water emitter in the sluice disposed at a still lower elevation than the water extraction point and above the exit point, coupled by at least one conduit from the drain, whereby water is collected from the course from the point of relatively lower elevation than the entry point and inserted again at the still lower elevation above the exit point via the water emitter.

* * * * *